US007565875B2

(12) United States Patent
Hoyt

(10) Patent No.: US 7,565,875 B2
(45) Date of Patent: Jul. 28, 2009

(54) JIB BOOM

(76) Inventor: John Garrison Hoyt, One Maritime Dr., Portsmouth, RI (US) 02871

( * ) Notice: Subject to any disclaimer, the term of this patent is extended or adjusted under 35 U.S.C. 154(b) by 0 days.

(21) Appl. No.: 11/862,236

(22) Filed: Sep. 27, 2007

(65) Prior Publication Data

US 2008/0190343 A1 Aug. 14, 2008

Related U.S. Application Data

(60) Provisional application No. 60/889,751, filed on Feb. 14, 2007.

(51) Int. Cl.
*B63H 9/10* (2006.01)

(52) U.S. Cl. ..... 114/98; 114/102.28

(58) Field of Classification Search ..... 114/89, 114/97, 98, 99, 102.1, 102.28, 102.3
See application file for complete search history.

(56) References Cited

U.S. PATENT DOCUMENTS 2,107,303 A 2/1938 Ljungstrom
3,408,973 A * 11/1968 Curtis et al. ..... 114/98
3,749,042 A 7/1973 Jackson
3,835,804 A 9/1974 Jackson
4,061,101 A 12/1977 Cook
4,367,688 A 1/1983 Godfrey
4,598,658 A * 7/1986 Eglais ..... 114/98
5,333,566 A * 8/1994 Wasowski, Jr. ..... 114/102.28
5,463,969 A 11/1995 Hoyt
6,425,338 B1 * 7/2002 Stevenson, IV ..... 114/102.28
6,857,380 B1 * 2/2005 Robinson ..... 114/98

FOREIGN PATENT DOCUMENTS

DE 3703744 8/1988

* cited by examiner

*Primary Examiner*—Lars A Olson
(74) *Attorney, Agent, or Firm*—Barlow, Josephs & Holmes, Ltd.

(57) ABSTRACT

A sailboat having a free standing jib boom mounted on a stub shaft, which rotates about an axis coextensive with the jib stay. The boom may extend not only aft of the stub shaft but also forward allowing unique rig configurations.

4 Claims, 7 Drawing Sheets

JIB BOOM

CROSS-REFERENCE TO RELATED APPLICATIONS

This application is related to and claims priority from earlier filed U.S. Provisional Patent Application No. 60/889,751, filed Feb. 14, 2007.

BACKGROUND OF THE INVENTION

The present relates generally to a jib boom for use on sailing vessels. In the past, conventional jib booms are generally affixed to a pedestal at the bow of the boat by a universal joint. The difficulty was that while such a jib boom served to assist in projecting maximum sail area, they did not facilitate tensioning of the leech of the sail. To overcome this problem, U.S. Pat. No. 5,463,969 discloses a jib boom that yields constant leech tension and it results in essentially a self-tacking vanged jib where the clew is held down. This arrangement also has difficulties in that many sailboats are rigged to carry spinnakers that are useful off the wind and particularly downwind. These are essentially triangular sails and have been generally known as symmetrical spinnakers. In order to fly such a spinnaker, it is necessary to tie one of the lower corners to a pole that extends from the mast of the boat, which in effect moves the sail outboard. The other lower corner is attached to a rope known as a sheet that is releasably fastened to the boat and serves to trim the angle of the spinnaker.

In recent years the asymmetrical spinnaker with a defined luff has proven to be more effective then a symmetrical spinnaker. In this case the luff edge of the spinnaker is fastened to the bow and a pole is used for the other corner with a sheet to control the angle. In order to utilize a pole however, whether it be a pole extending from the bow or a pole fastened to the mast, generally an additional crew member is required in order to handle the pole.

In view of the foregoing, there is a demand for a device to simplify the use of a spinnaker and a larger jib particularly on a cruising boat.

BRIEF SUMMARY OF THE INVENTION

In this regard, the present invention preserves the advantages of prior art spinnaker poles and combines such a spinnaker pole with a jib boom. The present invention therefore provides new advantages of a self tacking, self vanging jib boom that off wind also works as a spinnaker pole to extend and control the luff of an asymmetrical spinnaker. Further, the present invention overcomes not only many disadvantages of such currently available and unwieldy spinnaker poles but also offers the same self vanging and ease of trimming a jib.

The invention is generally directed to the novel and unique adaptation of a jib boom as seen in my U.S. Pat. No. 5,463,969 where the boom is moved further forward to rotationally embrace the forestay. This places the center of rotation right at the normal luff of the jib sail. As an added feature the furling gear for the jib may be placed below deck level to furl the jib. The invention also offers a jib boom that can be extended forward for a larger jib or for use of a larger spinnaker.

Essentially there is provided in a sailboat hull having a mast a jib boom with a stub shaft mounted in bearings in the hull wherein the jib stay passes through the stub shaft. With this arrangement a spinnaker, which is supported at its top by the mast, may have its luff edge fastened to the boom. Also the invention may have a forward projecting boom that retains the feature of self vanging, and permits fitting a large headsail.

It is therefore an object of the present invention to provide control of a jib and a spinnaker in one piece of equipment.

It is a further object of the present invention to simplify the hoisting and jibing of a spinnaker.

It is a further object of the present invention to locate the tack of a jib at the forward end of the jib boom beyond the rotational shaft to project the luff to windward when off the wind and reduce weather helm.

These together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 2:
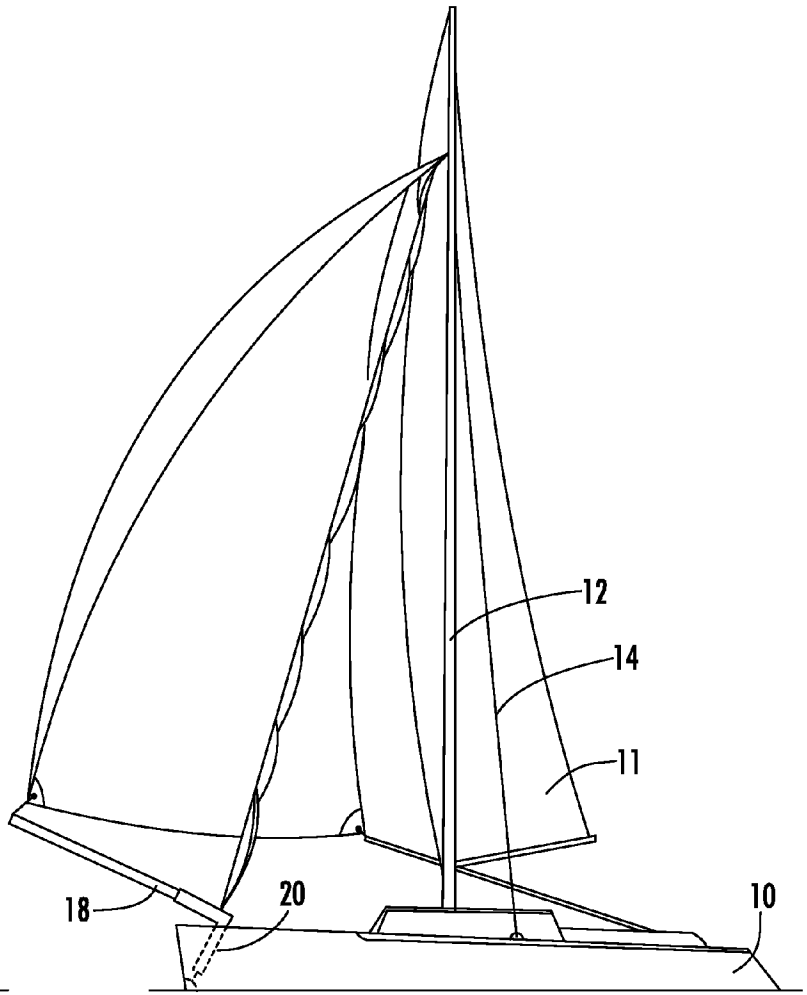
FIG. 2 illustrates the jib boom being used as a spinnaker pole.
Figure 1:
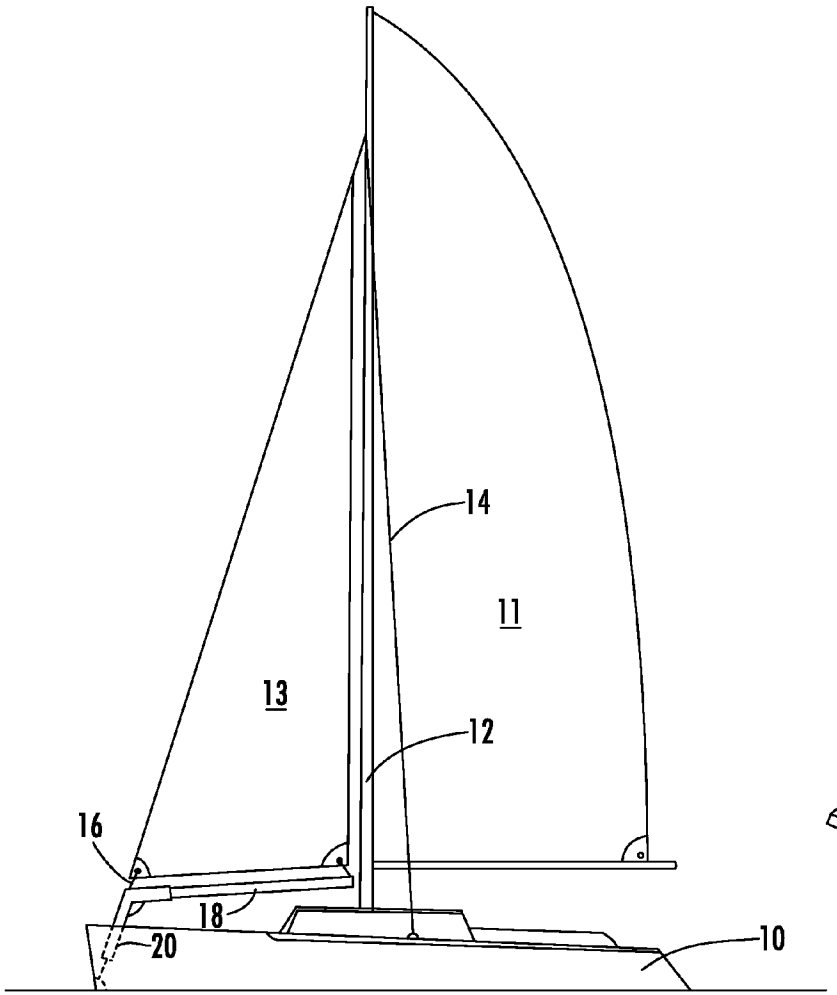
FIG. 1 illustrates a conventional sloop rig fitted with the jib boom of the invention.

The novel features which are characteristic of the present invention are set forth in the appended claims. However, the invention's preferred embodiments, togetherwith further objects and attendant advantages, will be best understood by reference to the following detailed description taken in connection with the accompanying drawings.

The drawings show port side views of the sailboat 10 with a mainsail 11 and a jib sail 13. A mast 12 is provided with the usual shrouds 14 and a jib stay 16. The jib boom 18 has a stub shaft 20 that is received in bearing means 22. The jib stay 16 passes through the center of the jib boom stub shaft and is fastened to the mast and to the hull of the boat as at 24. With this configuration this places the center of rotation at the luff 15 of the jib, which insures constant control of leech tension on all points of sail.

Figure 4:
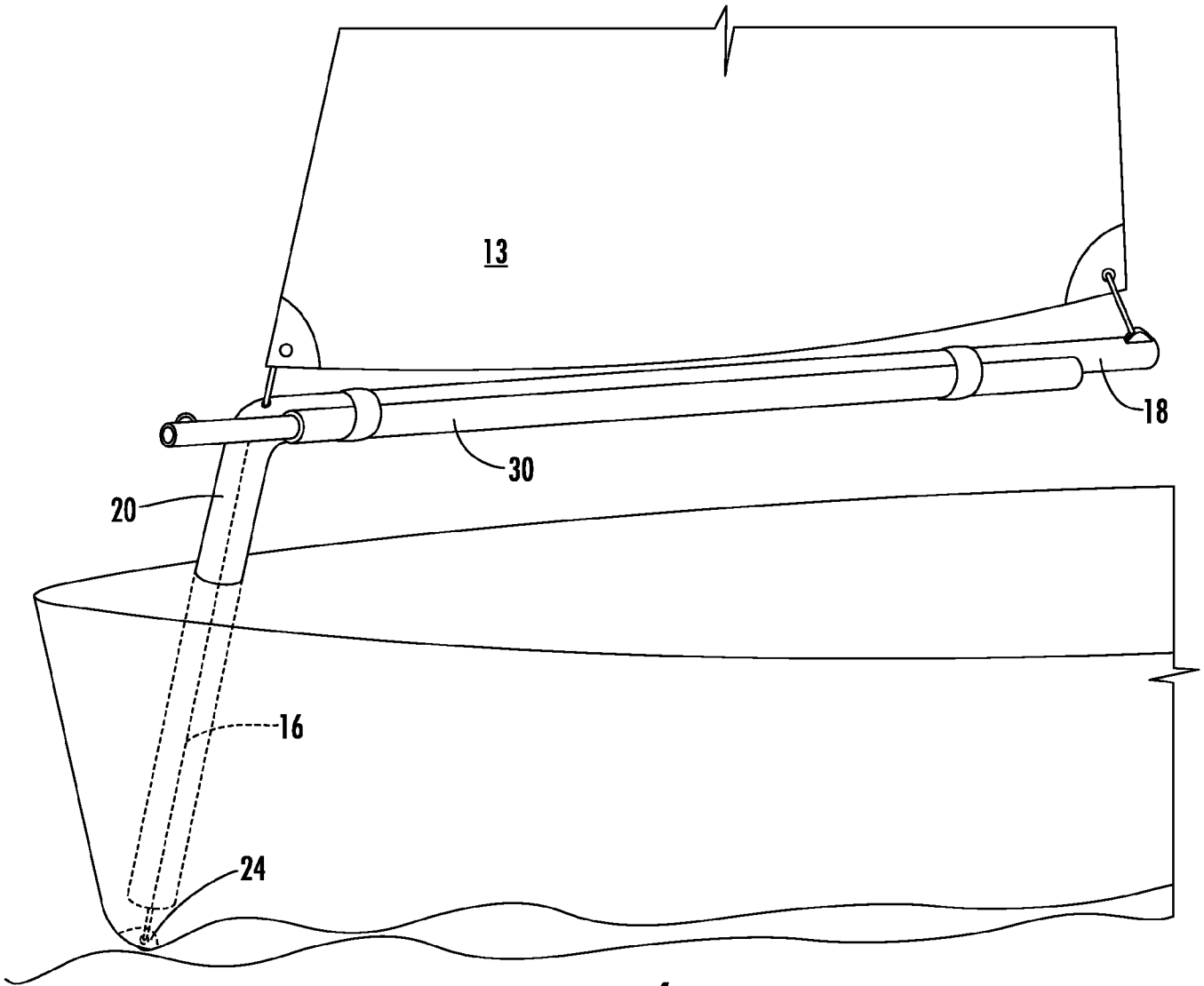
FIG. 4 is an illustration of an extender boom fitted on the boom.

Since the jib boom rotationally embraces the forestay 16 this allows a spinnaker boom to be carried by the jib boom. Referring to FIG. 4 there is shown a tubular housing 30 for a retractable spinnaker boom 32. This arrangement allows the luff of the spinnaker to be pulled out to windward as seen in FIG. 2. Conventional rigs that attach a spinnaker pole to the mast cannot achieve the same result as the pole particularly in a reaching mode. The reason for this result is that a conventional spinnaker pole will generally extend forward somewhat near the centerline of the boat. The sheet is led aft under the main boom and as can be appreciated most of the spinnaker is blanketed by the mainsail.

Figure 5:
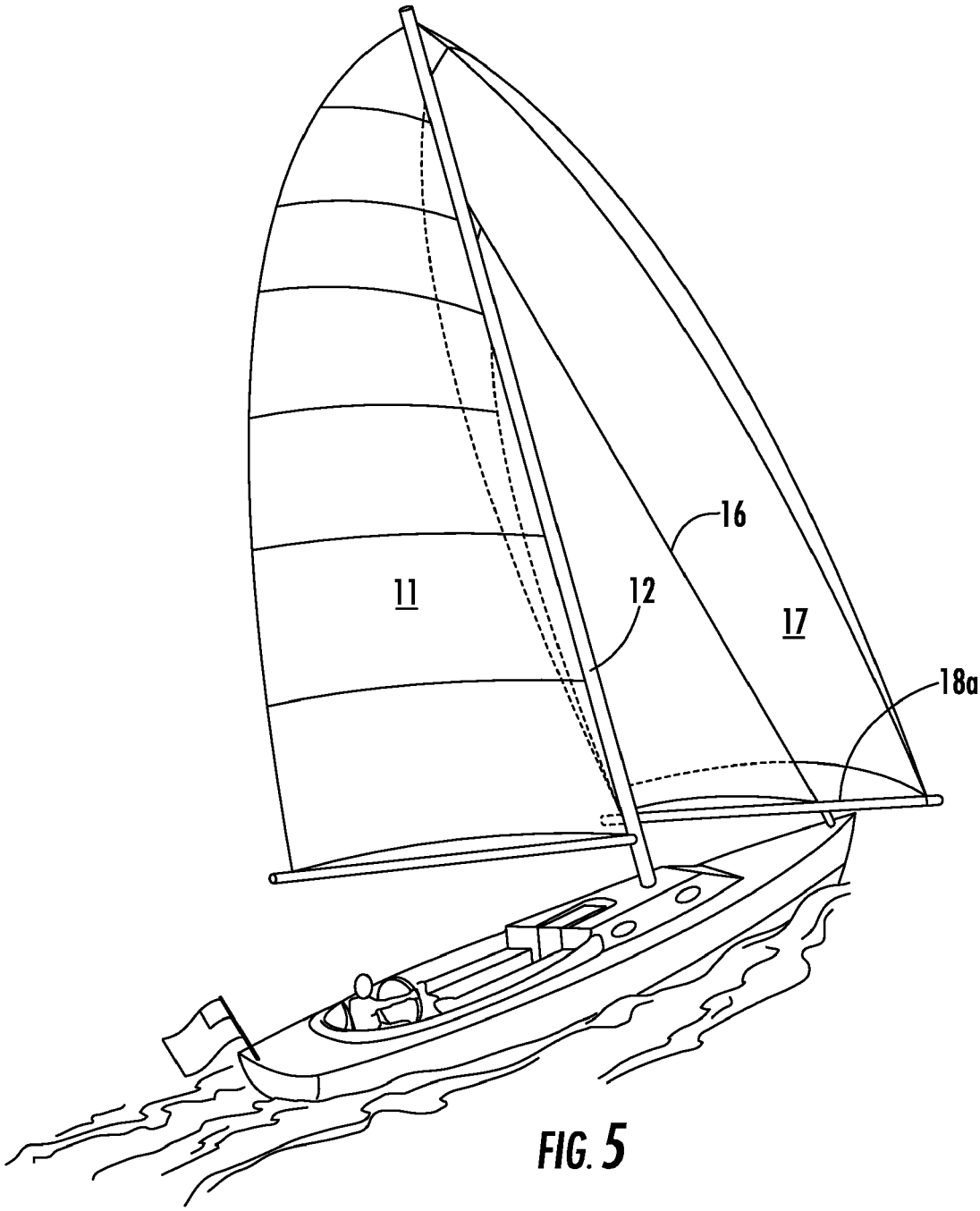
FIG. 5 is an illustration of a further embodiment of the invention illustrating a semi-balanced jib boom.
Figure 6:
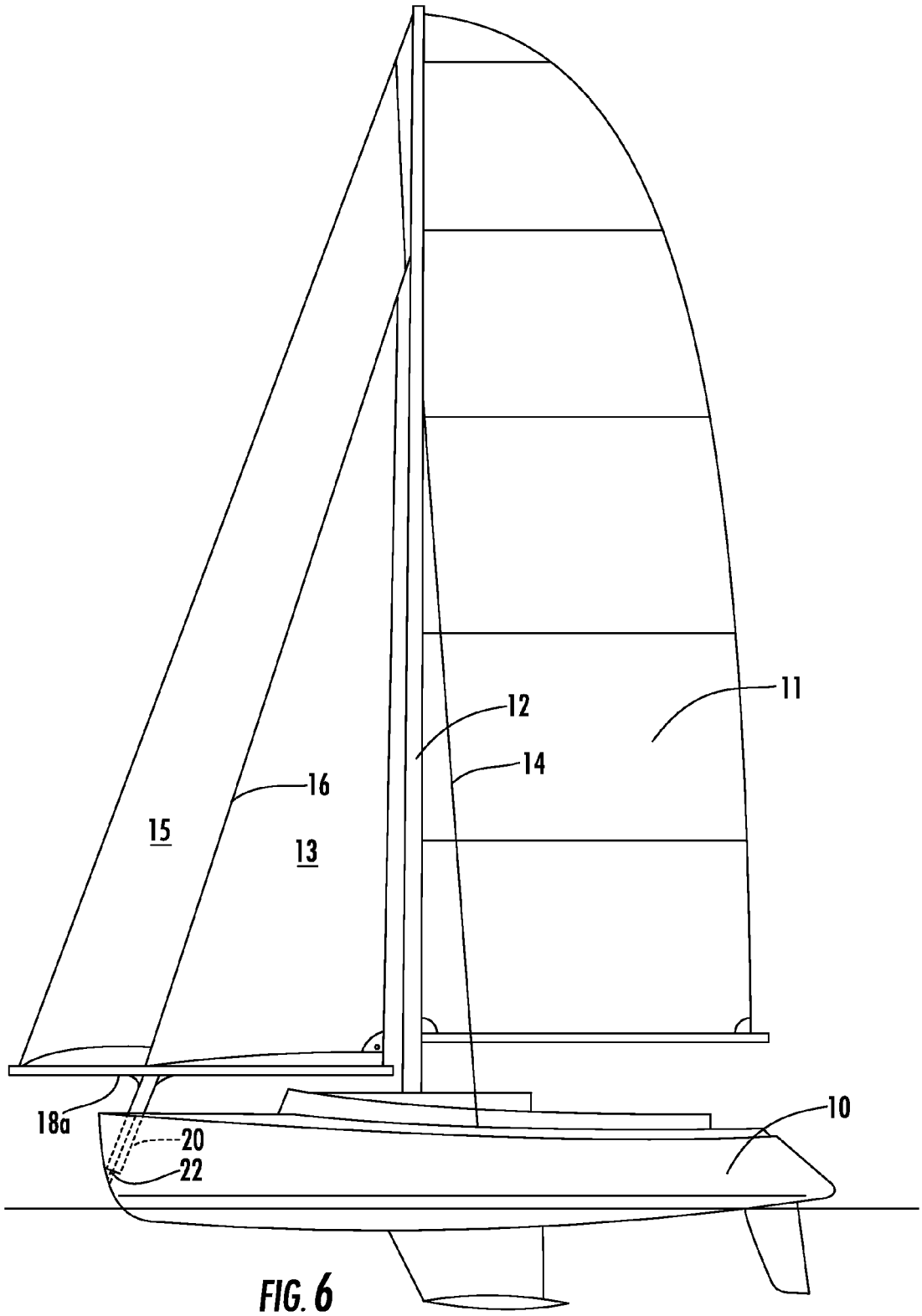
FIG. 6 is an illustration of the embodiment of FIG. 5 as a double head rig.

Referring to FIG. 5 there is shown a modified jib boom 18*a* extending on both sides of the rotational axis of the stub shaft. This has all the advantages of the previous arrangement seen in FIG. 4. This configuration is further unique in that a jib 15 is fitted and the result is a double head rig. With this twin jib arrangement, both sails are usefully projected to windward when eased off wind. This permits the jibs to have clear air and avoids the blanketing effect of the mainsail.

Figure 7:
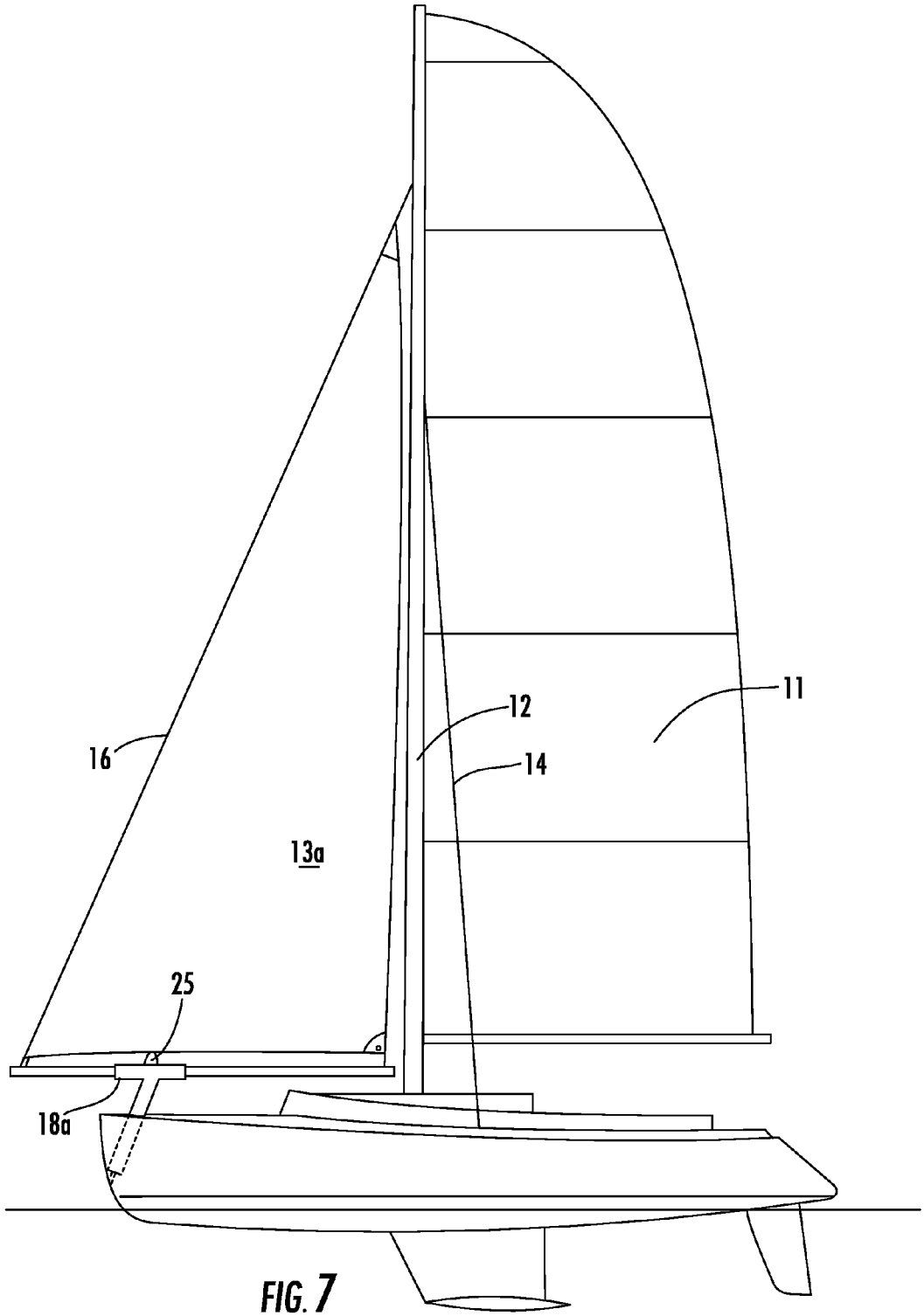
FIG. 7 is an illustration of moving the jib stay to the outer end of an extended jib boom.

Referring to FIG. 7, consider the jib stay with a pelican hook (not shown) into a link 25 at the upper terminus of the stub shaft. This stay can be moved to the outer end of the jib boom for a larger jib 13*a*. This jib will be semi balanced and can be trimmed by hand. Further, off the wind sail area is projected to windward and will reduce weather helm and blanketing of the mainsail.

Figure 8:
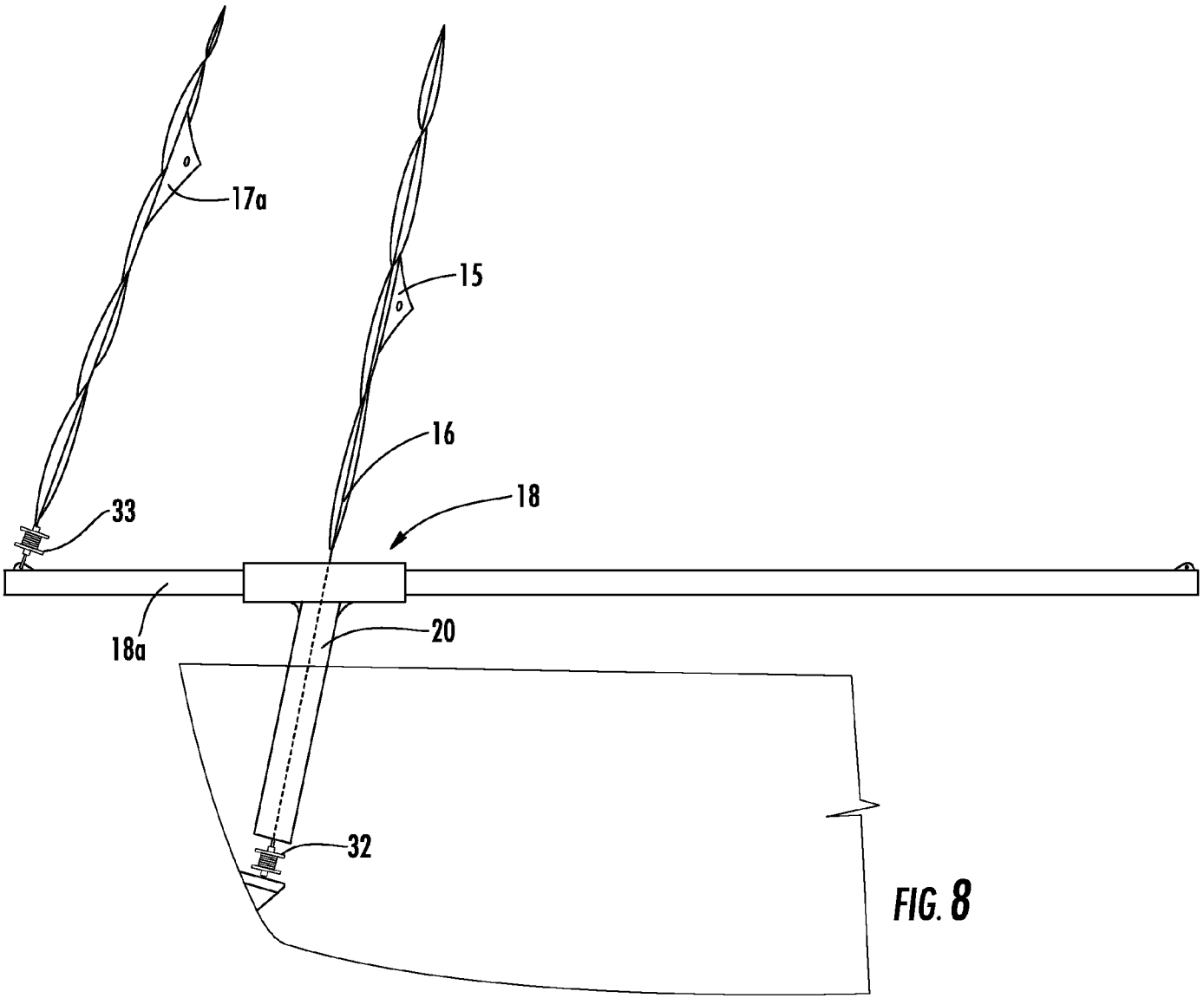
FIG. 8 is an illustration of a furled spinnaker on the forward end of the jib boom.

Referring to FIG. 8 there is illustrated a furled spinnaker 17*a* having a furling drum 33 with furling leads. To set this spinnaker simply unfurl the spinnaker and trim the jib boom to the desired angle with the existing jib sheet. This is both simpler and safer than any of the conventional practices for setting and trimming the spinnaker, all of which involve some degree of forward deck crew work. This particular combination with a jib 15 is a perfect combination for a cruising sailor. A self tacking jib 15 for upwind sailing and a spinnaker 17*a* for off and down wind sailing and it can all be controlled from the cockpit by lines and sheets as is commonly known in the art.

Let us consider how the invention operates with a spinnaker. When sailing to windward, a small tacking jib 13 (see FIG. 2) may be attached to the jib stay. To set a spinnaker the jib boom is brought to the centerline of the boat. The jib can be lowered or furled around the jib stay (see FIG. 2). The tack of the spinnaker 17 is attached to the end of the jib boom. All of this is easily reached on the foredeck. The jib boom 18 may be swung out and the spinnaker hoisted under the protection of the mainsail. The jib boom may now be swung out in front of the boat. The spinnaker is unfurled and the jib boom trimmed to the correct angle for the wind. To jibe, the boat is steered downwind and the jib boom is eased forward by the jib boom sheet. The jib boom will easily come around and can be controlled by the sheet from the cockpit. Once the jib boom is set, the mainsail my be jibed.

Figure 3:
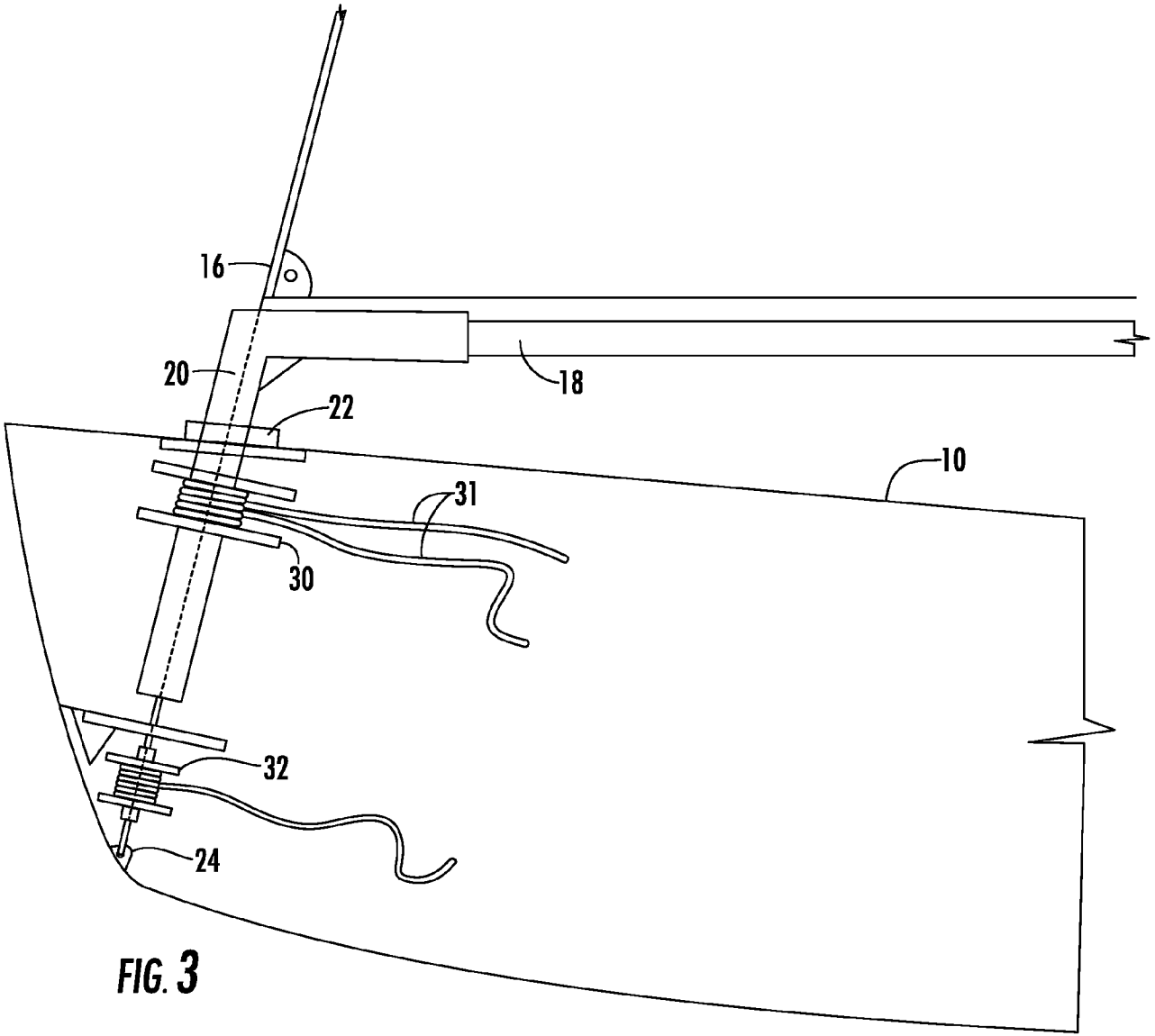
FIG. 3 is a detailed illustration of the jib boom with drums to control the angle of the boom and a furling drum for the jib sail.

As seen in FIG. 3 certain modifications may be achieved with the invention. A control drum 30 is affixed to the stub shaft and has lines 31 that may rotate the stub shaft from a remote location, such as the cockpit of the sailboat. In addition the jib stay may be fitted with a swivel fitting at the mast and a drum 32, sometimes described as a furling drum, attached to the lower end. This allows the jib to be easily furled as necessary.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A jib boom system for a sailboat having a mast, a hull and at least a jib stay from the mast to the hull, a jib boom integral with a stub shaft which is received in a bearing system in the hull of the sailboat, which shaft rotates on an axis about the jib stay which is attached to the hull whereby a terminus of the boom provides an attachment for a sail.

2. In a sailboat hull having a mast and a jib stay, a jib boom having a stub shaft means rotationally mounted by bearing means to the hull at an angle whereby the jib stay passes through the stub shaft to fastening means on the hull, the jib boom extending at least aft of the stub shaft at its upper terminus.

3. A sailboat as in claim 2 wherein a portion of the jib boom also extends forward.

4. A sailboat as in claim 2 wherein the jib stay is detachably secured to the stub shaft.

* * * * *